US006199409B1

(12) United States Patent
Shibata

(10) Patent No.: US 6,199,409 B1
(45) Date of Patent: Mar. 13, 2001

(54) KNITTING MACHINE FOR AND METHOD OF KNITTING HIGH DENSITY FABRICS

(75) Inventor: Takao Shibata, Osaka (JP)

(73) Assignee: Precision Fukuhara Works, Ltd. (JP)

( * ) Notice: Subject to any disclaimer, the term of this patent is extended or adjusted under 35 U.S.C. 154(b) by 0 days.

(21) Appl. No.: 09/584,590

(22) Filed: May 31, 2000

(30) Foreign Application Priority Data

May 31, 1999 (JP) ..... 11-151093

(51) Int. Cl.[7] ..... D04B 9/56
(52) U.S. Cl. ..... 66/25; 66/17; 66/148
(58) Field of Search ..... 66/8, 13, 17, 19, 66/20, 22, 24, 25, 26, 95, 148, 147

(56) References Cited

U.S. PATENT DOCUMENTS 4,028,910 * 6/1977 Wignall et al. ..... 66/26
5,727,400 * 3/1998 Lonati et al. ..... 66/148
5,761,931 * 6/1998 Liberman et al. ..... 62/64
5,924,310 * 7/1999 Conti ..... 66/148
6,040,668 * 3/2000 Huynh et al. ..... 318/471

* cited by examiner

*Primary Examiner*—Danny Worrell
(74) *Attorney, Agent, or Firm*—Alston & Bird LLP

(57) ABSTRACT

A double knit circular knitting machine is provided having a first needle bed in which transfer needles are mounted and a second bed in which ordinary needles devoid of transfer function are mounted in a double density to that of the transfer needles for knitting a high density fabric in any one of several predetermined patterns. A method of knitting high density fabric is provided utilizing such transfer and ordinary needles to form courses of stitch loops and, as dictated by the pattern, to transfer stitch loops from selected transfer needles to correspondingly selected ordinary needles.

13 Claims, 9 Drawing Sheets

PLAIN STITCH FABRIC

SINGLE JACQUARD FABRIC

SINGLE JACQUARD FABRIC

MOCK-INTERLOCK 1 x 1 RIB 2 x 1 RIB

MOCK-MILANO RIB

RIB JACQUARD

TRANSFER MESH

TRANSFER RIB JACQUARD

KNITTING MACHINE FOR AND METHOD OF KNITTING HIGH DENSITY FABRICS

FIELD OF THE INVENTION

The present invention relates to the knitting of fabrics and more particularly to a knitting machine for and method of knitting high density fabrics.

BACKGROUND OF THE INVENTION

The knitting of fabrics on two needle beds is well known for the formation of fashioned knit products. In such knitting, it is common to transfer stitch loops from the needles of one of the needle beds to needles of the other needle bed to form a predetermined knit pattern.

When such knitting is performed on a circular knitting machine, commonly referred to as a double-knit circular knitting machine, the transfer may be from dial needles on the dial needle bed to cylinder needles on the needle cylinder and vice-versa. Because of the transfer pockets on such transfer needles, and the concomitant thickness of such needles, the needle grooves in such dial and cylinder are commonly of a gauge of 14 or smaller (the smaller the gauge number, the wider the needle groove), with a gauge of 18 being currently considered to be the limit. This constraint is dictated by the requisite strength and durability of the transfer needles, i.e. a finer gauge needle would not possess these requisite characteristics for practical, commercial use. Heretofore, because of the constraint on the gauge of the transfer needles and the needle grooves in the dial and cylinder needle beds,. it has been difficult and impractical to knit high density fabrics, especially thin, light-weight, high density fabric.

SUMMARY OF THE INVENTION

With the foregoing in mind, it is an object of the present invention to provide a knitting machine for and method of knitting high density fabrics, including thin, lightweight, high density fabrics, without the difficulties and disadvantages heretofore encountered.

This object of the present invention is accomplished by providing a circular knitting machine having a cylinder and a dial, i.e. a double-knit circular knitting machine, in which one of the two needle beds has transfer needles therein and the other has ordinary needles with no transfer function arranged in a density twice the density of the needle bed having the transfer needles therein. In a preferred embodiment, the needle bed having the transfer needles therein is the dial and there is a swing mechanism for transferring stitch loops, one after another, from the dial transfer needles to the cylinder needles.

The method of the present invention includes providing the above-described arrangement of transfer needles in one needle bed and double-density ordinary needles in the other needle bed and operating the knitting machine to prepare for stitch loop transfer by raising selected ordinary needles in the second needle bed to the tuck position and opening the latches thereon; transferring stitch loops from corresponding transfer needles in the first needle bed to the selected ordinary needles in the second needle bed; and knitting high density knit fabric using the needles in the two needle beds in accordance with any one of a number of predetermined patterns.

BRIEF DESCRIPTION OF THE DRAWINGS

The foregoing and other objects and advantages of the invention, and the manner in which the same are accomplished, will be more readily understood when taken in conjunction with the accompanying detailed description and drawings in which.

DETAILED DESCRIPTION OF THE INVENTION

Figure 1:
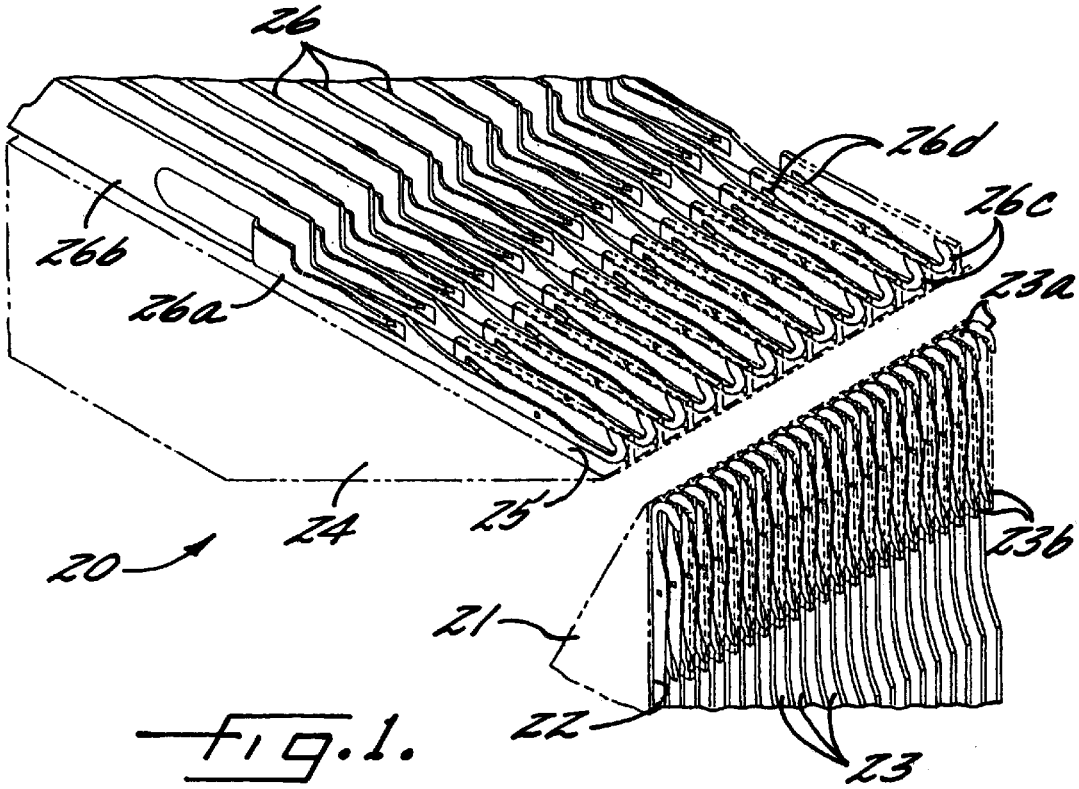
FIG. 1 is a fragmentary, somewhat schematic, perspective view of two needle beds of a circular knitting machine incorporating the present invention.

Referring now more particularly to the drawings and particularly to FIG. 1, there is illustrated a double-knit circular knitting machine, generally indicated at 20. Knitting machine 20 includes a rotatable needle cylinder 21 having a multiplicity of vertical needle grooves 22; the inserts between the needle grooves 22 have been omitted for drawing clarity. An ordinary knitting needle 23, having no transfer function, is slidably mounted in each needle groove 22 in needle cylinder 21. Needles 23 each have a hook 23*a* and a latch 23*b*, as is conventional.

Figure 6:
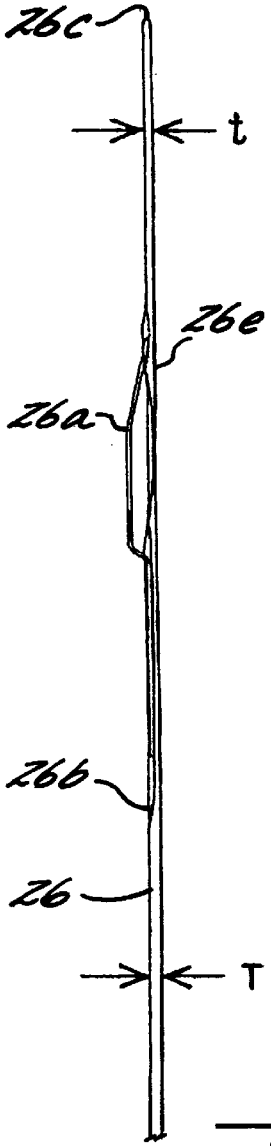
FIG. 6 is an elevational view of a transfer needle which may be used in accordance with the present invention.
Figure 7:
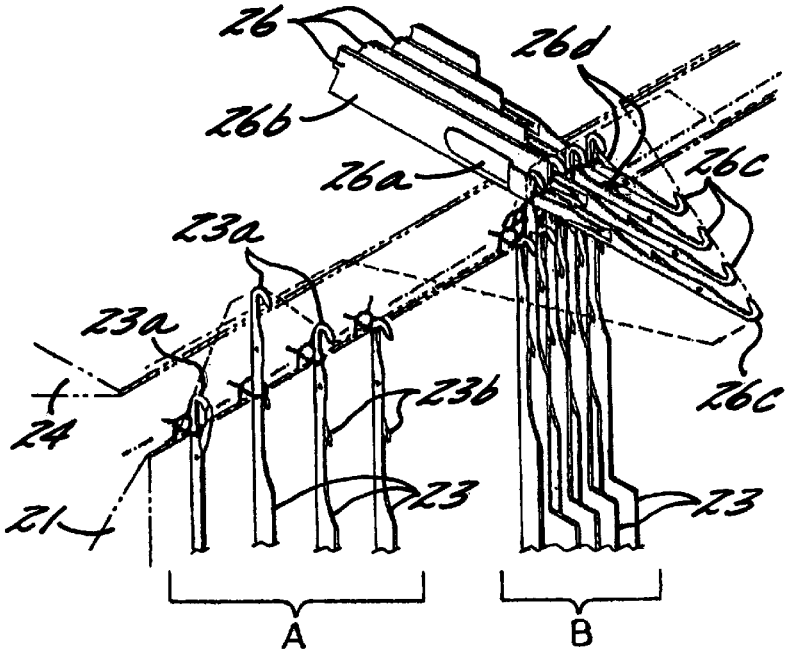
FIG. 7 is a fragmentary, schematic view illustrating needle movement during sections A and B of FIGS. 2–5.

A rotatable needle dial 24 is also part of knitting machine 20 and has a multiplicity of horizontal, radial grooves 25 therein. The inserts between the grooves 25 have been omitted for drawing clarity, but it should be understood that such are present in the knitting machine 20. A dial needle 26 is slidably mounted in each of the dial needle grooves 25. Each of the dial needles 26 includes a transfer function provided by a transfer pocket 26*a* on the side of the body portion 26*b* of the needle 26 in predetermined spaced relation to the needle hook 26*c* and the needle latch 26*d* (FIGS. 1, 6 and 7).

The dial grooves 25 are constructed and arranged to have a normal or conventional gauge, e.g. 14, for receipt of needles 26 with the transfer function. The needle grooves 22 are constructed and arranged to have a double gauge of twice the gauge of the dial grooves 25, e.g. 28, so that there are twice as many needle grooves 22 as there are dial grooves 26 and hence, twice as many ordinary, cylinder needles 22 as there are dial transfer needles 26.

Also, the tips 26*e* of the dial transfer needles 26, including the hooks 26*c* and latches 26*e*, preferably have a thickness t which is the same as the thickness of the ordinary needles 23, since although the needles 26 are inserted into the grooves 25 having a 14-gauge pitch, needles 26 must cooperate with and be inserted between the ordinary needles 23 which are inserted into cylinder grooves 22 having a 28-gauge pitch. However, the tips 26*e* must be thick enough to maintain the requisite strength and durability. Accordingly, the same thickness for the tips 26*e* as that of cylinder needles 23 will ensure that the dial transfer needles 26 and cylinder needles 23 will not physically contact each other during stitch loop transfers. If the same thickness is not used, the transfer needles 26 should preferably be the thinner of the two sets of needles.

Figure 2:
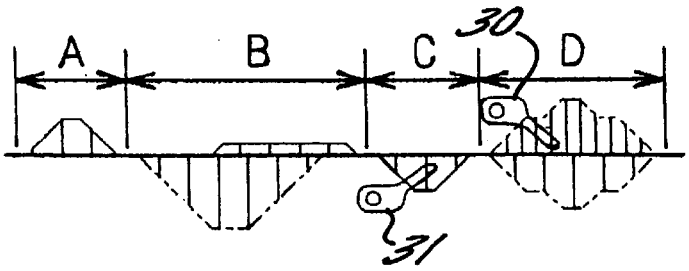
FIG. 2 is a schematic diagram of the needle movement in accordance with one embodiment of the present invention.

Referring now to FIG. 2, there is illustrated a diagram of needle movement in the knitting of a high density garment fabric in accordance with a first embodiment of the present invention which includes sections A, B, C and D. Section A is a stitch loop transfer preparatory section in which a cylinder needle 23 is raised to a tucking position (Section A of FIG. 7) and the latch 23*b* thereof is opened by a latch opener 30 for the cylinder needles 23. In this FIG. 2, latch opener 30 is shown in section D of the diagram, but is operable as needed in any section. Section B is a transfer section (see also FIG. 7) in which a dial needle 26 is extended to the transfer position, the cylinder needle 23 is raised to the transfer position and enters the transfer pocket 26*a* between the transfer pocket member and the body portion 26*b* of dial transfer needle 26 and also enters the stitch loop being transferred, the transfer needle 26 is retracted to remove the stitch loop being transferred therefrom, and the cylinder needle 23 is lowered to capture the transferred stitch loop thereon.

Section C is a latch opening section in which a dial latch opener 31 opens the latch on the dial transfer needle 26 once the stitch loop has been transferred to prepare the dial needle 26 for subsequent knitting. Section D is a knitting section for knitting high density fabric in accordance with any of several different patterns.

Figure 3:
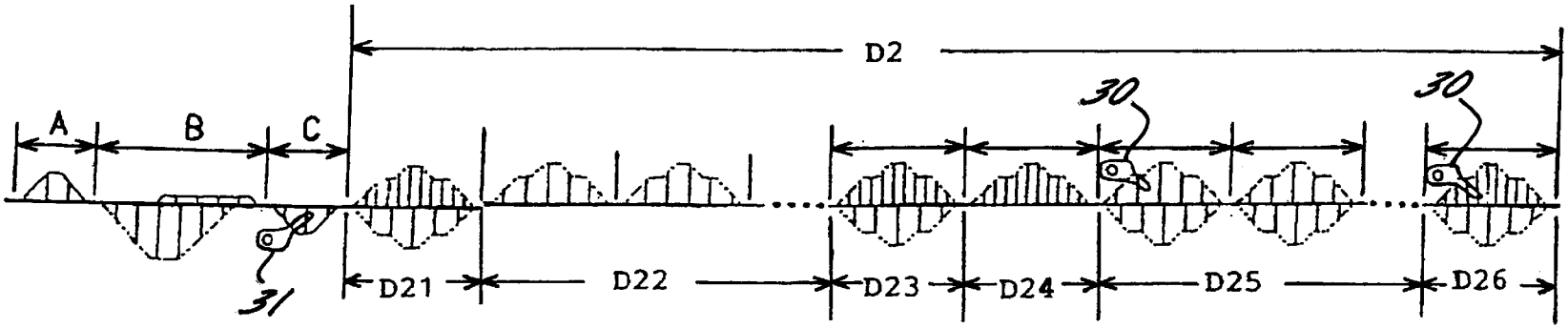
FIG. 3 is a view similar to FIG. 2 of needle movement in accordance with another embodiment of the present invention.

Referring now to FIG. 3, there is illustrated a diagram of needle movement in the knitting of high density fabric in accordance with a second embodiment of the present invention which includes section A, B and C, which are the same as those sections in FIG. 2, and a section $D_2$, which is subdivided into sub-sections $D_{21}$, $D_{22}$, $D_{23}$, $D_{24}$, $D_{25}$ and $D_{26}$. Since sections A, B and C are the same as described in the description of FIG. 2, those sections will not be re-described.

In section D, the sub-section $D_{21}$ is a knitting section in which all of the cylinder needles 23 and all of the dial needles 26 are operated to knit stitch loops. In sub-section $D_{22}$, only those cylinder needles 23 in every other course are operated to knit a tubular fabric to prevent runs. Thereafter, in sub-section $D_{23}$, a raveling cord is knit on both sets of needles 23 and 26 for one course. Then, in sub-section $D_{24}$, only the cylinder needles 23 are selected and operated, and a yarn switcher (not shown) is activated to a non-feeding position or condition so that it becomes easier to pull the yarn, and all of the stitch loops on the cylinder needles 23 are dropped. In sub-section $D_{25}$, a 1×1 rib fabric is knit for a required number of courses using all of the dial needles 26 and every other cylinder needle 23 to form a hem. In this section $D_{25}$, the hem is knitted as the latches on the cylinder needles 23 are opened by a latch opener 30. Once the hem is formed, in sub-section $D_{26}$, a body fabric is knit using all of the cylinder needles 23 and dial needles 26 to form a 2×1 rib fabric. In this section, all of the cylinder needles 23 that were inoperable during the knitting of the raveling cord in sub-section $D_{23}$ perform knitting as the latch opener 30 opens the latches thereon.

Whenever the predetermined pattern dictates the transfer of stitch loops from the dial transfer needles 26 to the cylinder needles 23, the sections A, B and C may be interposed in the diagram of needle movement. Various fabric patterns are illustrated in FIGS. 8–13 and will be described more fully hereinafter.

Figure 4:
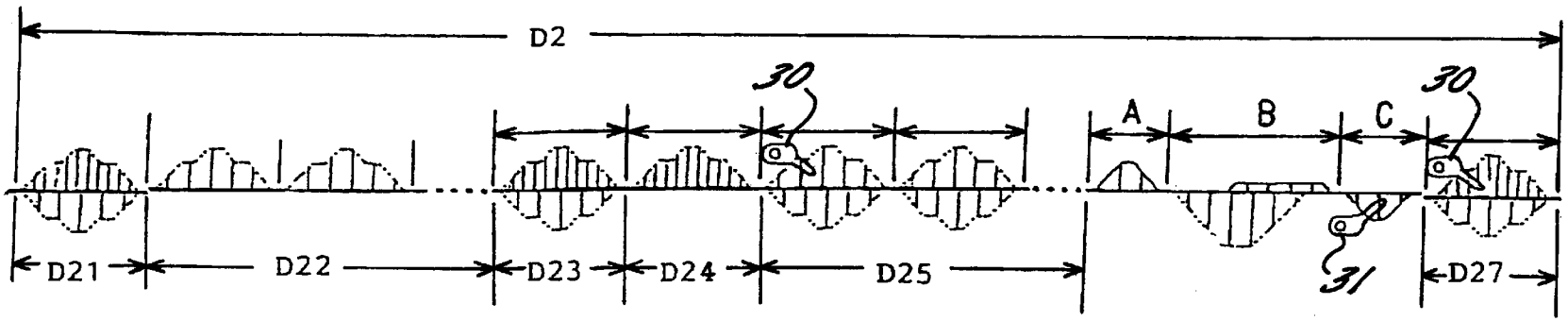
FIG. 4 is a view similar to FIGS. 2 and 3 of needle movement in accordance with a further embodiment of the present invention.

Referring to FIG. 4, there is illustrated a diagram of needle movement in accordance with a third embodiment of the present invention which is similar to the diagram in FIG. 3 except that sections A, B and C are interposed in section $D_2$ between sub-section $D_{25}$ and a sub-section $D_{27}$. Therefore, after a 1×1 rib hem is knitted in sub-section $D_{25}$, the stitch loops on the dial needles 26 are transferred to the cylinder needles 23.

In FIG. 3, a 2×1 rib fabric is knitted in sub-section $D_{26}$ to form the body fabric. In sub-section $D_{27}$ in FIG. 4, a single needle, 28-gauge, high density single jacquard (including sheeting) fabric is knitted on the cylinder needles 23, and the dial needles are in the welt position. All of the other sub-sections $D_{21}$–$D_{24}$ are as described in FIG. 3 and will not be further described.

Figure 5:
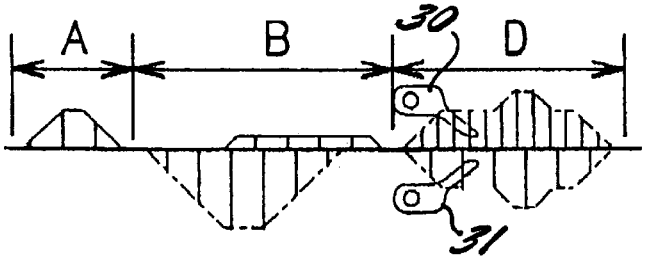
FIG. 5 is a view similar to FIGS. 2–4 of needle movement in accordance with a still further embodiment of the present invention.

FIG. 5 illustrates a diagram of needle movement in accordance with a fourth embodiment of the present invention which includes sections A, B and D. This diagram is similar to the diagram illustrated in FIG. 2 except that the dial latch-opening section C is omitted and the dial latch opener 31 is utilized in section D of the diagram in FIG. 5, along with the cylinder latch opener 30.

Figure 8:
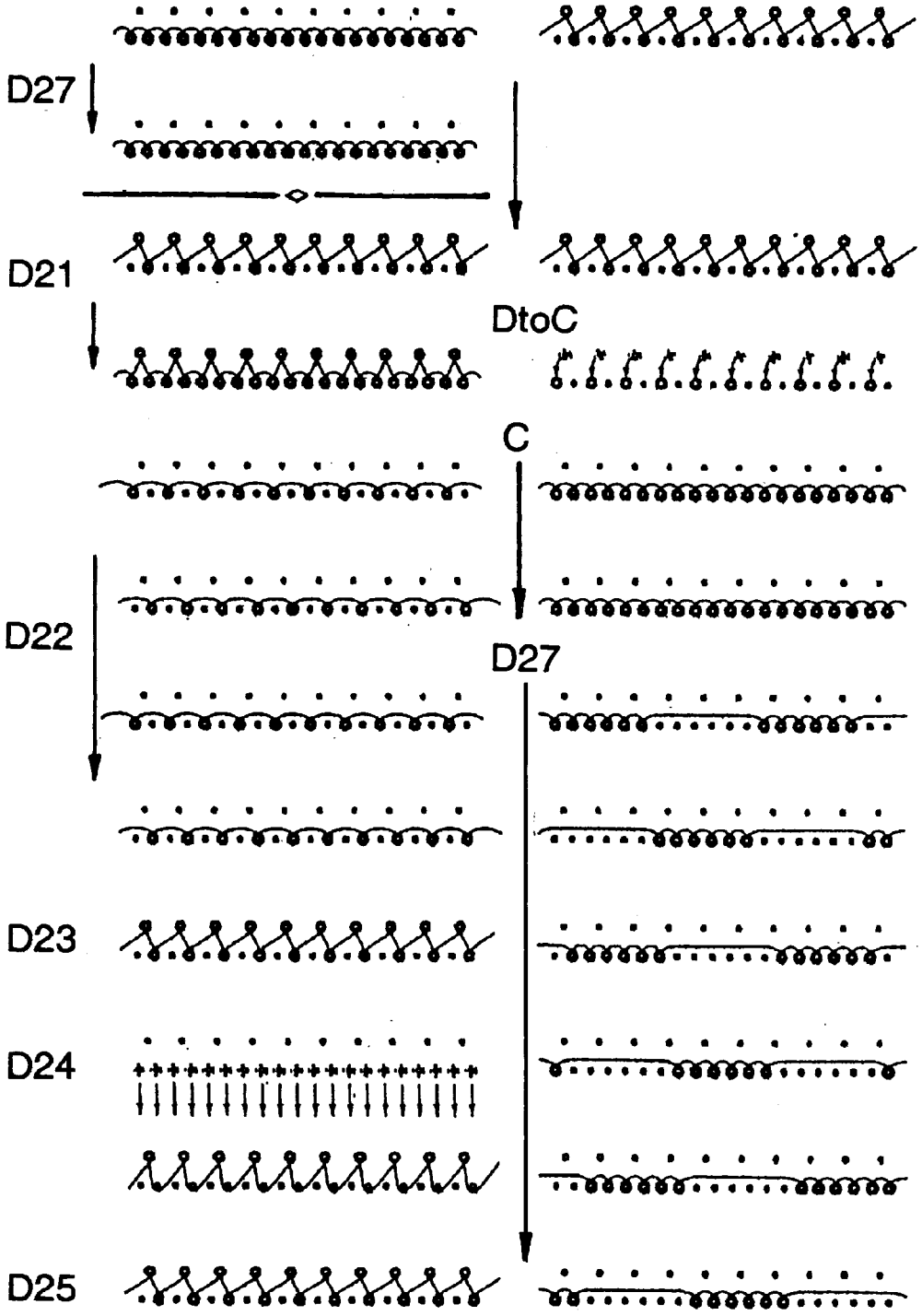
FIG. 8 is a schematic stitch pattern for an embodiment of knit fabric produced in accordance with the present invention.

Referring now to FIGS. 8–13, there is illustrated examples of various garment fabric patterns which can be produced using the knitting machine and method of the present invention. FIG. 8 illustrates a garment fabric knit in sections similar to the diagram illustrated in FIG. 4. In this pattern, $D_{21}$ corresponds to sub-section $D_{21}$ in the diagrams of FIGS. 3 and 4 and shows that the dial needles 26 and cylinder needles 23 are selected and set-up to begin the knitting of the cuff or hem. $D_{22}$ refers to sub-section $D_{22}$ and shows a tubular plain jersey knit to prevent runs; while $D_{23}$ refers to sub-section $D_{23}$ of the needle movement diagrams and shows a draw thread or raveling cord knit in for one course. $D_{24}$ refers to sub-section $D_{24}$ of the diagrams and shows that the stitch loops on the cylinder needles 23 are dropped. $D_{25}$ illustrates the knitting of a 1×1 rib hem or cuff for the requisite number of courses; followed by "D to C" which refers to sections A and B where the stitch loops are transferred from the dial needles 26 to the cylinder needles 23. "C" refers to setting up the cylinder needles 23 for single jacquard knitting with the dial needles 26 in the welt position and $D_{27}$ refers to sub-section $D_{27}$ in which the body fabric is knit in a single jacquard, high density fabric design, which ends at the top of the left side of the schematic in FIG. 8.

Figure 9:
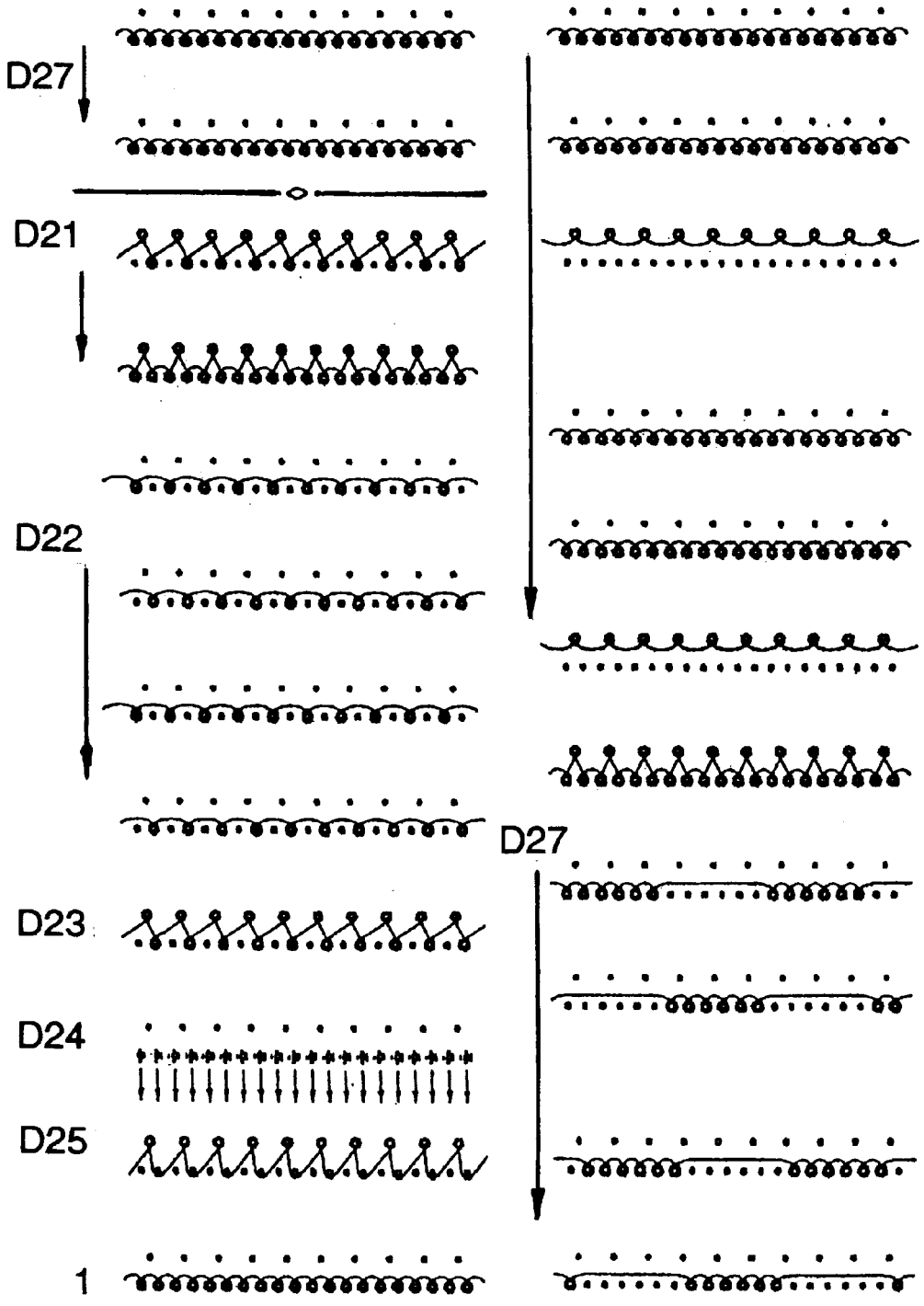
FIG. 9 is a view similar to FIG. 8 of another embodiment of knit fabric produced in accordance with the present invention.

FIG. 9 illustrates another fabric design similar to the design of FIG. 8 except the cuff is knit of plain jersey stitches rather than a 1×1 rib stitches as in FIG. 8 and there is no transfer from the dial needles 26 to the cylinder needles 23.

Figure 10:
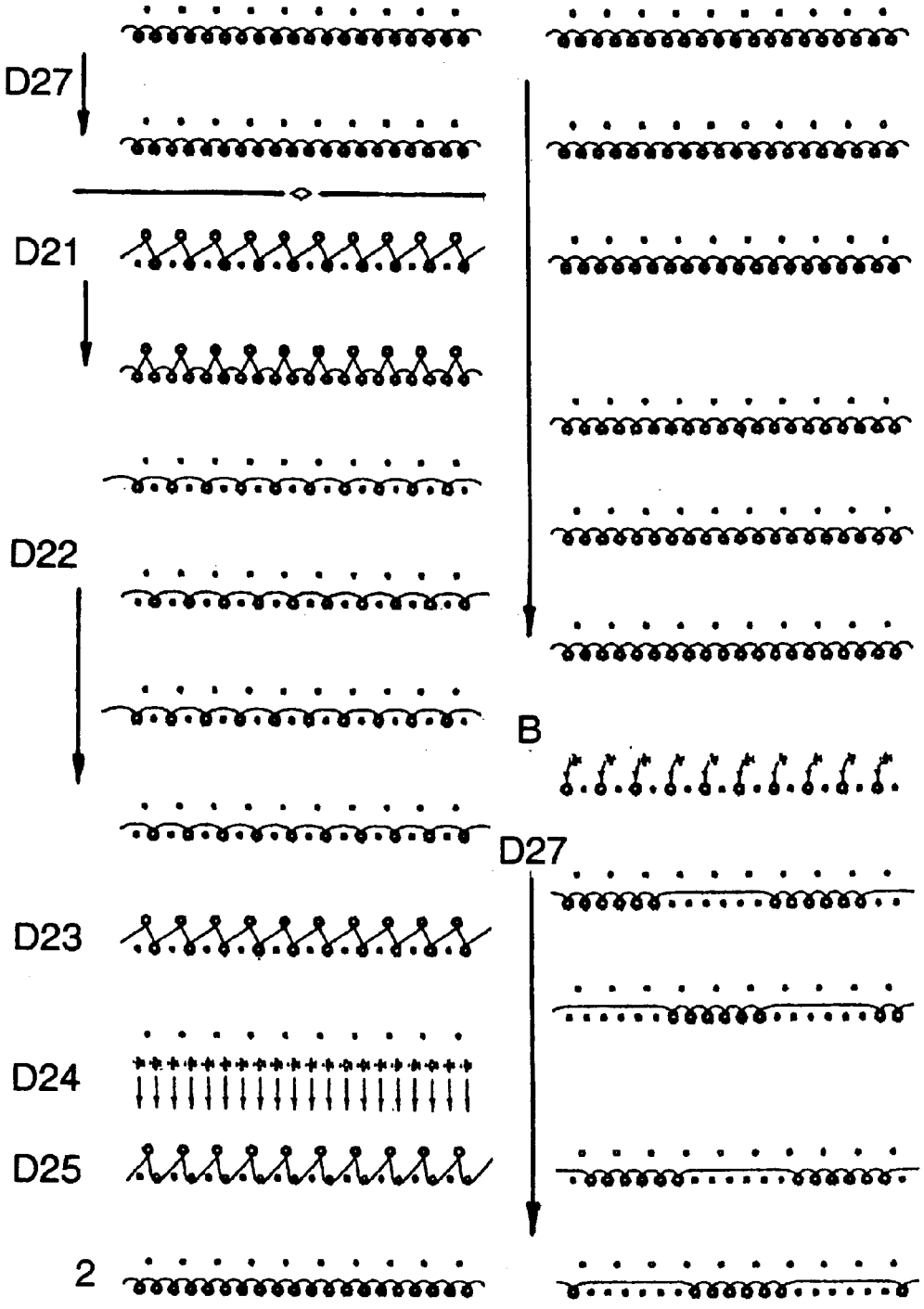
FIG. 10 is a view similar to FIGS. 8 and 9 of a further embodiment of knit fabric produced in accordance with the present invention.

FIG. 10 illustrates still another fabric design which is similar to the design of FIG. 9 except that stitch loops are transferred from the dial needles 26 to the cylinder needles 23 as is indicated at "B". Otherwise the designs are very similar.

Figure 11A:
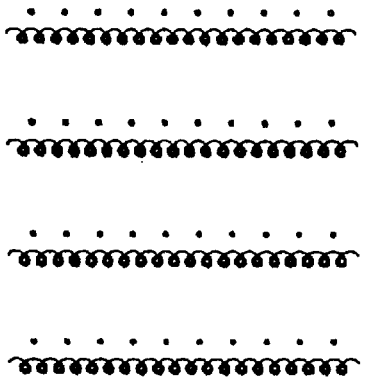
FIGS. 11A, 11B and 11C are views similar to FIGS. 8–10 and collectively illustrate a still further embodiment of knit fabric produced in accordance with the present invention.
Figure 11B:
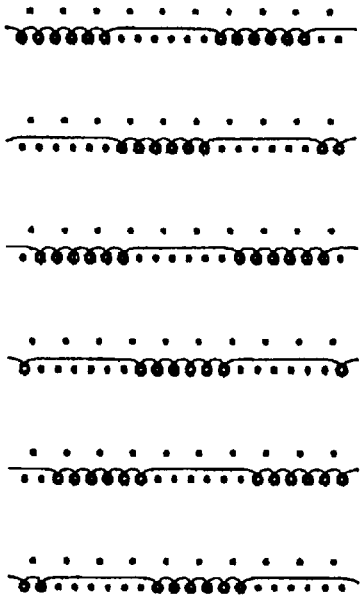
Figure 11C:
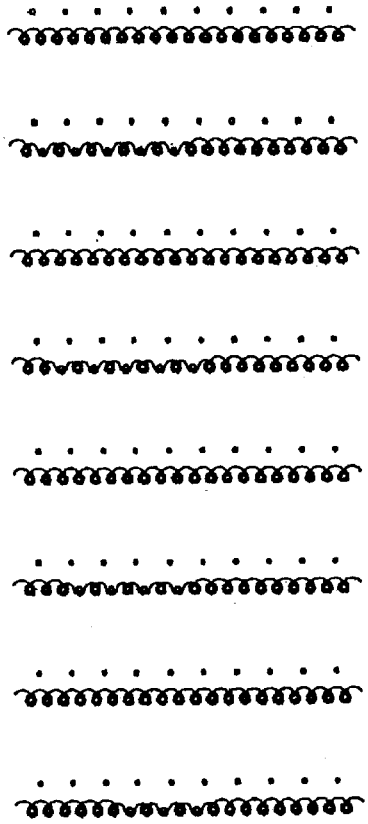
Figure 12A:
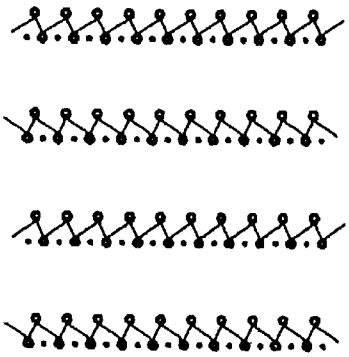
FIGS. 12A, 12B, 12C, 12D and 12E are views similar to FIGS. 8–10 and collectively illustrate yet another embodiment of knit fabric produced in accordance with the present invention.
Figure 12B:
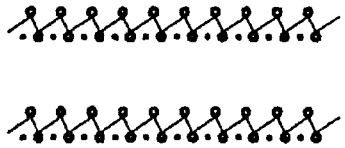
Figure 12C:
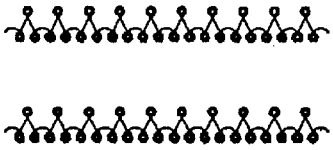
Figure 12D:
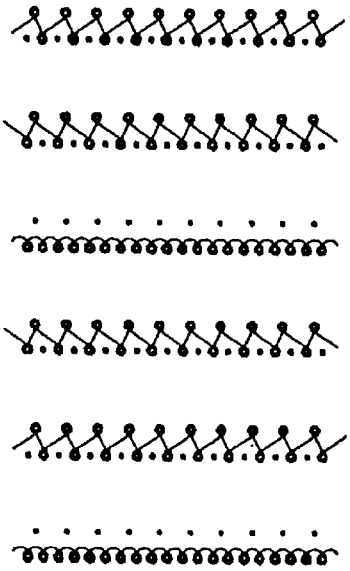
Figure 12E:
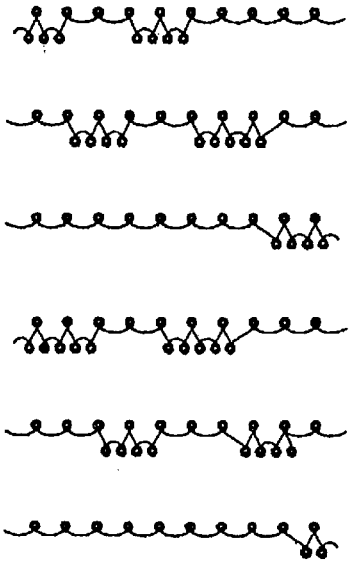

FIG. 11A illustrates a stitch pattern for a plain stitch fabric, while FIGS. 11B and 11C illustrate different single jacquard stitch patterns. Similarly, FIG. 12A illustrates a mock-interlock stitch pattern; FIG. 12B illustrates a 1×1 rib stitch pattern; FIG. 12C illustrates a 2×1 rib stitch pattern; FIG. 12D illustrates a mock-milano rib stitch pattern; and FIG. 12E illustrates a rib jacquard stitch pattern.

Figure 13A:
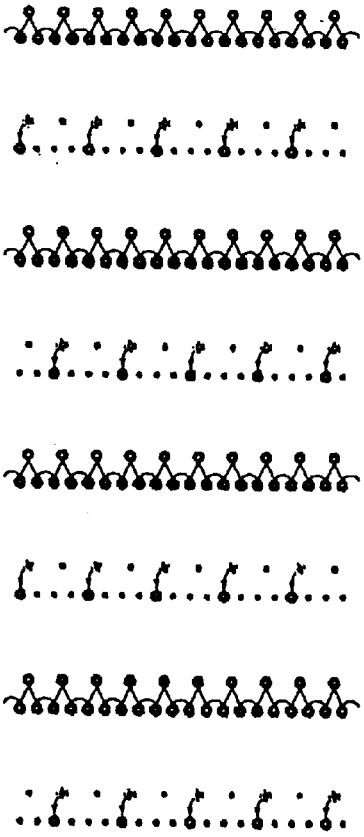
FIGS. 13A and 13B are views similar to FIGS. 8–12 of a still further embodiment of knit fabric produced in accordance with the present invention.
Figure 13B:
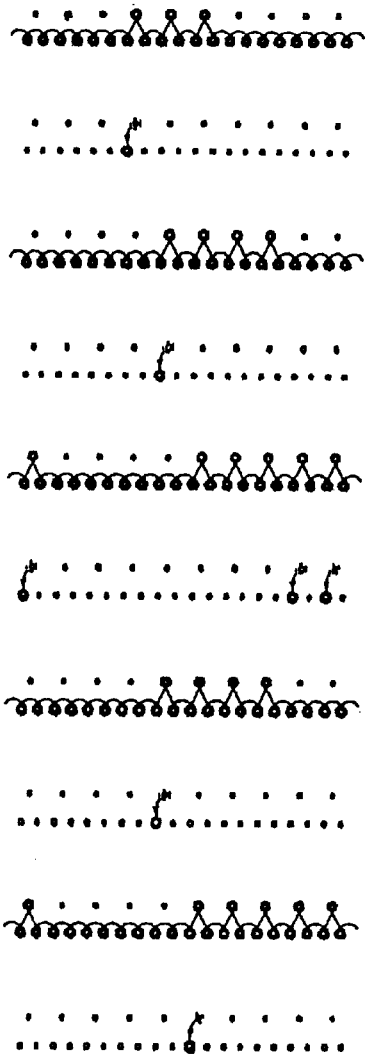

Finally, FIG. 13A illustrates a transfer mesh stitch pattern; and FIG. 13B illustrates a transfer rib jacquard stitch pattern. Any of these stitch patterns or combinations of stitch patterns may be used in the knitting of the body of the garment fabric.

It should be understood that these stitch patterns and fabric designs are exemplary only and do not represent the extent of fabric designs and stitch patterns encompassed by the present invention. Other stitch patterns and fabric designs will occur to those fabric designer or other artisans skilled in the knitting arts.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A circular knitting machine for knitting high density fabrics comprising a first needle bed having first needle grooves therein, said first needle grooves having a first gauge suitable for transfer needles, a second needle bed operatively associated with said first needle bed for the knitting of double-knit or single-knit fabric and having second needle grooves therein, said second needle grooves having a second gauge double said first gauge so that said second needle bed can accommodate twice as many needles, first knitting needles slidably mounted in said first grooves in said first needle bed and having transfer pockets thereon to provide for the transfer of stitch loops from said first needles, and second knitting needles slidably mounted in said second grooves in said second needle bed and being devoid of any transfer function, said second knitting needles being adapted to receive transferred stitch loops from said first knitting needles.

2. A circular knitting machine according to claim 1 wherein said first needle bed comprises a rotatable dial and said second needle bed comprises a rotatable cylinder.

3. A circular knitting machine according to claim 1 wherein said first knitting needles have tips which are of the same thickness as the thickness of tips of said second knitting needles.

4. A method of knitting high density fabrics on a circular knitting machine having first and second needle beds with first and second needle grooves therein, the first needle grooves in said first needle bed having a first gauge and the second needle grooves in said second needle bed having a second gauge double said first gauge, said method comprising providing said first needle bed with a transfer needle in each of said first grooves and said second needle bed with an ordinary needle in each of said second grooves so that there are twice as many ordinary needles as there are transfer needles, moving said needles in said grooves while supplying yarn thereto to knit a high density fabric in accordance with a predetermined pattern, and while transferring stitch loops from selected transfer needles to correspondingly selected ordinary needles as dictated by the predetermined pattern by raising the ordinary needles to a tuck position while opening latches thereon, extending the selected transfer needles to a transfer position, raising the selected ordinary needles to a capture position to capture the stitch loops to be transferred, withdrawing the selected transfer needles to shed the stitch loops therefrom and lowering the selected ordinary needles with the transferred stitch loops thereon.

5. A method according to claim 4 wherein latches on the selected transfer needles are opened after the transferred stitch loops are shed thereform.

6. A method according to claim 5 wherein said knitting needles are moved to knit a hem followed by a high density body fabric.

7. A method according to claim 6 wherein said body fabric is knit in a 2×1 rib stitch design.

8. A method according to claim 6 wherein said body fabric is knit in a single jacquard stitch design.

9. A method according to any of claims 6–8 wherein all of said transfer needles and said ordinary needles are used to knit the body fabric.

10. A method according to claim 6, including knitting a run prevention tubular fabric in a 1×1 stitch design on said ordinary needles between the hem and the body fabric.

11. A method according to claim 10 wherein a raveling cord is knit for one course after the run prevention tubular fabric.

12. A method according to claim 11 wherein following the knitting of the raveling cord, only ordinary needles are selected and moved and all of the stitch loops thereon are dropped.

13. A method according to claim 6 wherein the hem is knit on a selected number of transfer needles and half that number of ordinary needles in a 1×1 rib-stitch design.

* * * * *